US007394405B2

(12) United States Patent
Godden

(10) Patent No.: US 7,394,405 B2
(45) Date of Patent: Jul. 1, 2008

(54) LOCATION-BASED NOTIFICATIONS

(75) Inventor: Kurt S. Godden, Sterling Heights, MI (US)

(73) Assignee: GM Global Technology Operations, Inc., Detroit, MI (US)

( * ) Notice: Subject to any disclaimer, the term of this patent is extended or adjusted under 35 U.S.C. 154(b) by 207 days.

(21) Appl. No.: 11/142,584

(22) Filed: Jun. 1, 2005

(65) Prior Publication Data

US 2006/0273930 A1 Dec. 7, 2006

(51) Int. Cl.
*G08G 1/1123* (2006.01)

(52) U.S. Cl. ..... 340/996; 340/993; 340/988

(58) Field of Classification Search ..... 340/573.1, 340/573.4, 903, 907, 988, 990, 991, 993, 340/995, 996; 455/456.1, 457, 456.2
See application file for complete search history.

(56) References Cited

U.S. PATENT DOCUMENTS

| | | | | |
|---|---|---|---|---|
| 5,648,770 | A | 7/1997 | Ross | 340/994 |
| 5,717,392 | A * | 2/1998 | Eldridge | 340/996 |
| 6,085,148 | A | 7/2000 | Jamison et al. | 701/211 |
| 6,177,905 | B1 * | 1/2001 | Welch | 342/357.13 |
| 6,266,612 | B1 | 7/2001 | Dussell et al. | 701/207 |
| 6,360,101 | B1 | 3/2002 | Irvin | 455/456 |
| 6,587,782 | B1 | 7/2003 | Nocek et al. | 701/200 |
| 6,625,457 | B1 * | 9/2003 | Raith | 455/456.1 |
| 6,680,675 | B1 | 1/2004 | Suzuki | 340/988 |
| 6,850,837 | B2 | 2/2005 | Paulauskas et al. | 701/200 |
| 7,015,817 | B2 * | 3/2006 | Copley et al. | 340/573.4 |
| 7,039,420 | B2 * | 5/2006 | Koskinen et al. | 455/456.1 |
| 2004/0107037 | A1 | 6/2004 | Straub | 701/93 |
| 2004/0207522 | A1 | 10/2004 | McGee et al. | 340/539.13 |
| 2005/0012611 | A1 | 1/2005 | Osman | 340/539.13 |

FOREIGN PATENT DOCUMENTS

WO WO 03/102842 A1 11/2003

* cited by examiner

*Primary Examiner*—Van T. Trieu

(57) ABSTRACT

A method for location-based notifications, the method including receiving a request for a notification from an input device. A current location of the input device is determined in response to the receiving. A reminder location is set responsive to the current location of the input device determined in response to the receiving. On a periodic basis, a new current location of the input device is determined and compared to the reminder location. A notification is provided if the new current location is within a proximity threshold of the reminder location.

20 Claims, 3 Drawing Sheets

LOCATION-BASED NOTIFICATIONS

BACKGROUND OF THE INVENTION

The present disclosure relates generally to electronic notification systems, and more particularly, to providing location-based notifications.

Various devices exist to aid individuals in the organization and reminder of tasks to be performed. For example, personal notes and post-its placed on refrigerator doors, calendars, and the like, help to remind individuals of tasks to be accomplished. Schedule books and personal organizers also help individuals keep track of time-sensitive tasks and appointments. If electronic calendars and organizers are used, users may be electronically notified via the device's alarm or notification process when it is time to carry out a particular task or appointment.

If a task is not time-sensitive, individuals often place such a task in a separate to-do list. Typical tasks entered into a non-time-sensitive to-do list include, for example, buying a particular article at a particular store, stopping by the bank, going to the post office, going to the dry-cleaner, and running other types of errands. Whether such a to-do list is maintained manually or electronically, the individual must make an effort to check the list in order to not forget a particular task that needs to be accomplished. Failure to check the to-do list at a particular time and be reminded of the task might cause inefficient management of the individual's time. For instance, an individual who is heading to the grocery store might forget to stop by the bank which is on the way to the grocery store. This might cause the individual to waste additional time to retrace his or her steps to make the visit to the bank, or to forego this task completely. In either case, the individual has made ineffective use of his or her time.

Another issue has to do with the individual having to create a to-do list and planning an execution sequence ahead of time. This is not always practical as an individual might remember that dry cleaning is ready to be picked up when driving by the dry cleaning store. It might not always be practical for the individual to stop, and as such, the individual may desire to add the dry cleaning stop to his or her to-do list. As an example, a parent driving a child to a soccer practice may pass the dry cleaning store and make a mental note to stop and retrieve some suits that were recently dropped off at the dry cleaning store. The parent cannot stop immediately because of the more time-pressing task of dropping the child off at the soccer field in time for the start of soccer practice. After dropping off the child, the parent may or may not remember to retrieve the suits on the return trip. It would be desirable for the parent to be able to easily request a notification, or to add a to-do list item to a task list, that would provide a reminder to pick up the suits the next time that he or she is in the vicinity of the dry-cleaning store.

BRIEF DESCRIPTION OF THE INVENTION

According to one aspect of the invention, a method is provided for location-based notifications. The method includes receiving a request for a notification from an input device. A current location of the input device is determined in response to the receiving. A reminder location is set responsive to the current location of the input device determined in response to the receiving. On a periodic basis, a new current location of the input device is determined and compared to the reminder location. A notification is provided if the new current location is within a proximity threshold of the reminder location.

In another aspect of the invention, a system is provided for location-based notifications. The system includes an input device, a location detection device, an output device and a processor. The processor is in communication with the input device, the location detection device and the output device. The processor includes instructions for facilitating receiving a request for a notification from an input device. A current location of the input device is determined by the location detection device in response to the receiving. A reminder location is set responsive to the current location of the input device determined in response to the receiving. On a periodic basis, a new current location of the input device is determined by the location detection device and compared to the reminder location. A notification is provided via the output device if the new current location is within a proximity threshold of the reminder location.

In a further aspect of the invention, a computer program product is provided for location-based notifications. The computer program product includes a storage medium readable by a processing circuit and storing instructions for execution by the processing circuit for performing a method. The method includes receiving a request for a notification from an input device. A current location of the input device is determined in response to the receiving. A reminder location is set responsive to the current location of the input device determined in response to the receiving. On a periodic basis, a new current location of the input device is determined and compared to the reminder location. A notification is provided if the new current location is within a proximity threshold of the reminder location.

BRIEF DESCRIPTION OF THE DRAWINGS

Referring now to the figures, which are meant to be exemplary embodiments, and wherein the like elements are numbered alike.

DETAILED DESCRIPTION OF THE INVENTION

Figure 1:
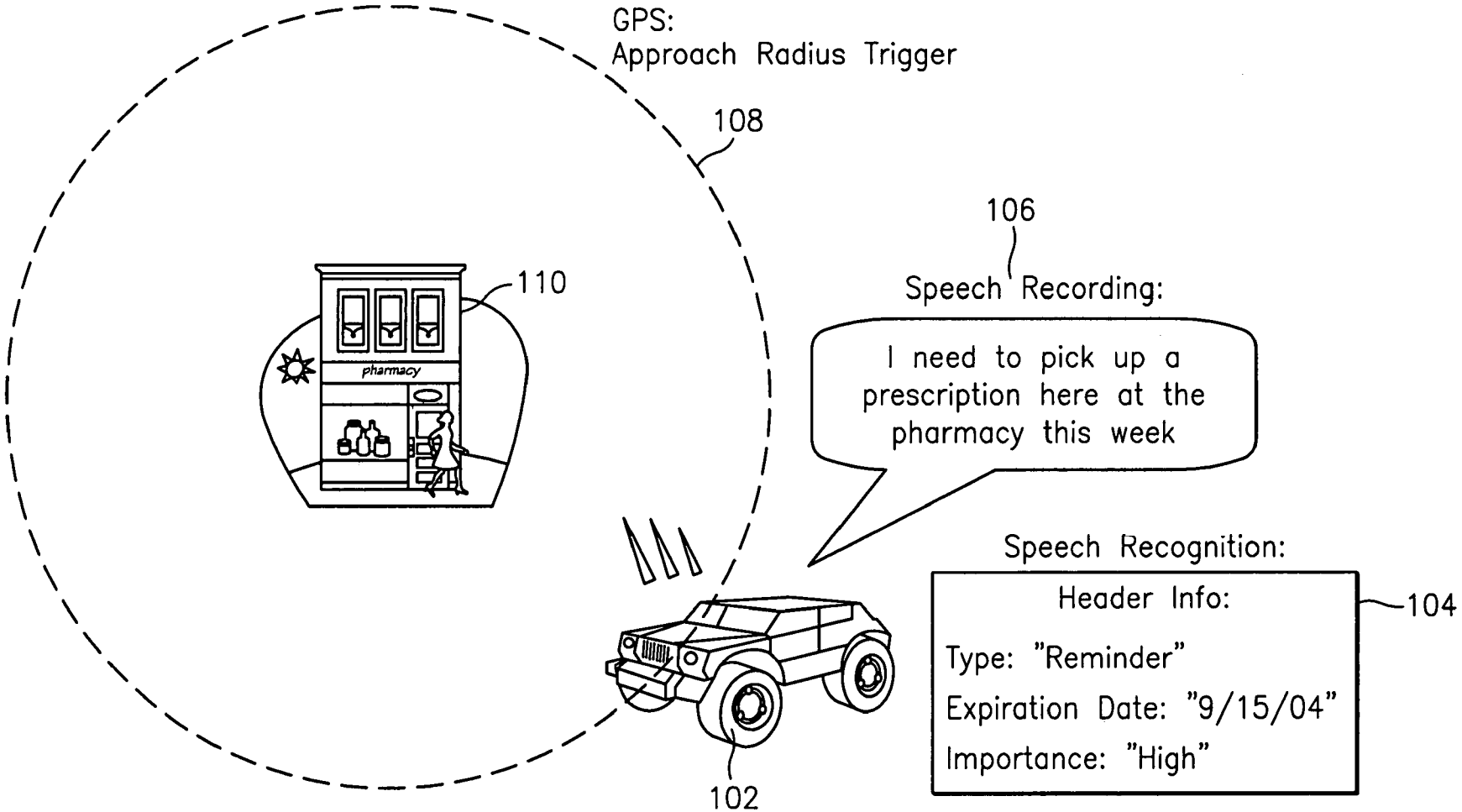
FIG. 1 is a block diagram of a location-based notification service that may be implemented by exemplary embodiments of the present invention.

Exemplary embodiments of the present invention allow a user of a mobile user device (e.g., a driver of a vehicle equipped with a mobile user device) to attach a virtual voice-based notification to a location, such as a business, with information that can be retrieved by the driver at a later time. This can be performed in a hands free manner when driving a vehicle. For example, a driver driving past a pharmacy may remember that he needs to pick up a prescription there, but cannot do it at the moment because he is driving his children to school. He may then activate a speech recognition system and specify a "request for notification." The driver is then prompted for header information such as type of notification (e.g., reminder), expiration date (if any), level of importance, etc. This information is recognized by the speech recognition system and stored as text. The driver is then prompted to record the contents of the notification, and the driver states "I need to pick up my allergy medicine prescription at this pharmacy." This information is not recognized by the speech recognition system, but instead is recorded and saved as an audio file. In addition to saving the notification header information and contents, the current location coordinates obtained from a location detection system (e.g., GPS) are also saved and associated with the notification.

Later, when the driver enters some pre-determined radius, or proximity threshold, of the location coordinates associated with the notification, the vehicle detects this position and spontaneously presents the driver with the notification information. The system uses a text-to-speech device to read back the stored text-based header information and then replays the audio portion back to the driver, potentially asking the driver if he wants to hear the contents associated with the notification. Upon approval from the driver, the system then replays the audio content of the notification, reminding the driver to stop and get the allergy medicine prescription.

The notification is deleted after any stored expiration date, or if the driver explicitly deletes the notification. For example, after replaying the content of the notification to the driver, the driver may be asked if he wants to keep the note or delete it. If kept, the notification would be activated again the next time that the driver entered within a specified radius, or proximity threshold, of the location associated with the notification.

Because the content of the notification is recorded, not speech-recognized, that content can be of arbitrary complexity and subject matter. It may include, but is not limited to, shopping lists, work-related information, and to-do lists. Exemplary embodiments of the present invention include the creation of notifications that are independent of location coordinates (i.e., a simple voice-based memo recorder). But even in this latter mode, since the header information is speech recognized, the note has the flexibility of being further processed (e.g., it could be mailed by the vehicle to a target recipient).

FIG. 1 is a block diagram of a location-based notification service that may be implemented by exemplary embodiments of the present invention. It depicts a vehicle 102 that is equipped with a location-based notification system. The vehicle is located within a proximity threshold 108 of a reminder location 110 for a notification that includes textual header information 104 and voice content 106. As shown in FIG. 1, the driver of the vehicle 102 is notified and is presented with both the textual header information 104 and the voice content 106. In exemplary embodiments of the present invention, the header information 104 is provided to the driver via a text to voice device, or alternatively via text on a screen located on the dashboard of the vehicle 102. The voice content 106 is provided to the driver via a speaker located on the vehicle 102.

Figure 2:
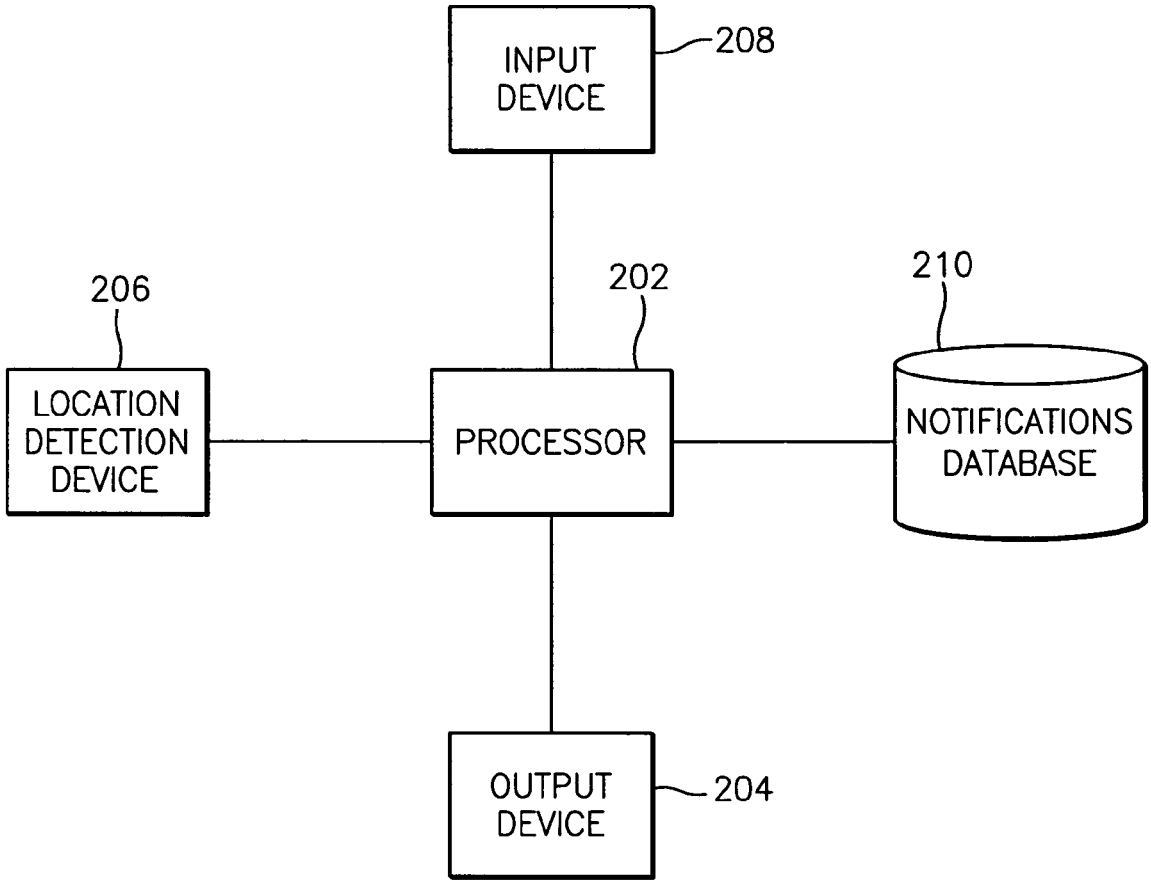
FIG. 2 is a block diagram of a system for providing location-based notifications that may be utilized by exemplary embodiments of the present invention.

FIG. 2 is a block diagram of a system for providing location-based notifications that may be utilized by exemplary embodiments of the present invention. The system includes several components: a processor 202, an output device 204, a location detection device 206, an input device 208 and a notifications database 210. In exemplary embodiments of the present invention, all of the components are located on a mobile user device.

The input device 208 is utilized by a user to request a notification. The input device can accept a variety of input formats and may be implemented by any device known in the art including, but not limited to, a microphone, a recorder, a keyboard, and/or a touch screen device. In exemplary embodiments of the present invention, the input device 208 receives a request for notification via voice input. The user is prompted for header information 104 such as type of notification (e.g., reminder, memo, to-do, personal and warning), expiration date of notification (if any), and level of importance of the notification. In exemplary embodiments of the present invention, notifications are categorized by categories such as church, work, school, shopping, gift, home, repair, etc. The type of header information 104 collected, if any, may be customized to user requirements and may include any other category of information that describes the notification. The header information 104 is input to a voice recognition device and/or software module and translated into text data for storage on the notifications database 210.

Also stored in the notifications database 210 as part of the notification is the voice content 106 of the notification as described previously. The voice content 106 of the notification is stored in the notifications database 210 as voice or audio data. Because the voice content 106 is not translated into text, the voice content 106 of the notification can be free form. The navigation coordinates (e.g., GPS coordinates) are also stored as part of the notification in the notifications database 210. The GPS coordinates are stored as numerical or text data.

The notifications database 210 may be implemented by any database or storage scheme for storing, updating and retrieving the header information 104, voice content 106 and navigation coordinate data associated with a notification. The notifications database 210 may be physically located on any storage medium known in the art and in exemplary embodiments is contain within the processor 202. In alternate exemplary embodiments the notifications database 210 is stored remote from the processor 202 and accessed via a link or via one or more networks for transferring data within the notifications database 210. The notifications database 210 stores one or more notifications.

Alternate exemplary embodiments of the present invention include a user field for storing notifications for two or more different users. The user may identify himself or herself via a keypad or touch screen input device 208. Other types of user identification technology may also be utilized such as speaker-identification technology within the context of a speech recognition system (e.g., the system recognizes a user based on voice characteristics of the user, ie. a "voiceprint" of the user). When the location-based notification system is located within a vehicle, a key fob or key may be utilized to automatically identify the user. Depending on user requirements, some or all notifications may be shared between the users and some or all notifications may be specific to a particular user.

In exemplary embodiments of the present invention, the location detection device 206 is implemented by a GPS detector device that determines the current GPS coordinates, or current geographic location, of the mobile user device. The mobile user device may include a self-contained GPS detector device 206 or the mobile user device may have access to an existing GPS detector located outside the mobile user device. The GPS detector device 206 located outside of the mobile user device may also be utilized by other applications (e.g., mapping software) that require GPS coordinate data. Any geographic location detection device which determines a current geographic location may be utilized by exemplary embodiments of the present invention.

The output device 204 provides the notification or initiates the notification depending on the type of notification requested and the type of implementation. For example, the notification may require an initial haptic alert to get the attention of the user so that he or she can be prompted to receive the header and content of a notification. When the location-based notification system is contained in a handheld mobile user device, the haptic alert may include having the mobile user device providing the notification by vibrating to get the attention of the user. Alternatively, when the location-based notification system is installed in the dashboard of a vehicle, the notification may be initiated by transmitting a message to the steering wheel or seat pan controls to cause them to vibrate when alerting the driver that a location based notification has been triggered. Depending on the user requirements, the output device may be implemented to create a variety of output formats including, but not limited to visual output (e.g., dashboard display and display screen), audio output (e.g., via speakers on a vehicle utilized by a radio and text to voice software), and/or haptic output (e.g., vibrate seat pan, vibrate steering wheel). Alerting the driver that a location-based notification has been triggered may also be performed via a text or graphics display and/or via an audio alarm. In exemplary embodiments of the present invention, the header information 104 is provided to the user via a visual output means and the voice content 106 is provided via an audio output means. In alternate exemplary embodiments of the present invention, the header information 104 is provided to the user via an audio output means that includes text to voice software and speakers, and the voice content 106 is provided to the user via an audio output means that includes speakers.

The processor 202 may be implemented by any processor known in the art for providing the process flow described herein. In exemplary embodiments of the present invention the processor 202 is located within a mobile user device and provides interfaces to the output device 204, location detection device 206, input device 208 and notifications 210 which each may or may not also be located within the mobile user device. In an alternate exemplary embodiment of the present invention, the processor 202 and the notifications database 210 are located external to the vehicle (e.g., at a central host system) and the input device 208, the output device 204 and the location detection device 206 are located in the vehicle. Communication between the processor 202 and the input device 208 and output device 204 is via a wireless network technology.

In exemplary embodiments of the present invention, the components are all included within a hand held mobile user device and dedicated to providing location-based notifications. In alternate exemplary embodiments, for example where the location-based notification system is part of a vehicle, some or all of the components may be shared with other functions provided by the vehicle. For example, the location detection device 206 may be implemented by a GPS device that is already located in a vehicle for providing mapping software and directions, the input device 208 may be implemented by speech recognition software that is utilized by a mobile service such as "OnStar®." The output device 204 may include the display on a dashboard and other visual, audio and/or haptic output devices utilized by the vehicle for other functions (e.g., radio speakers and mapping software display device).

Figure 3:
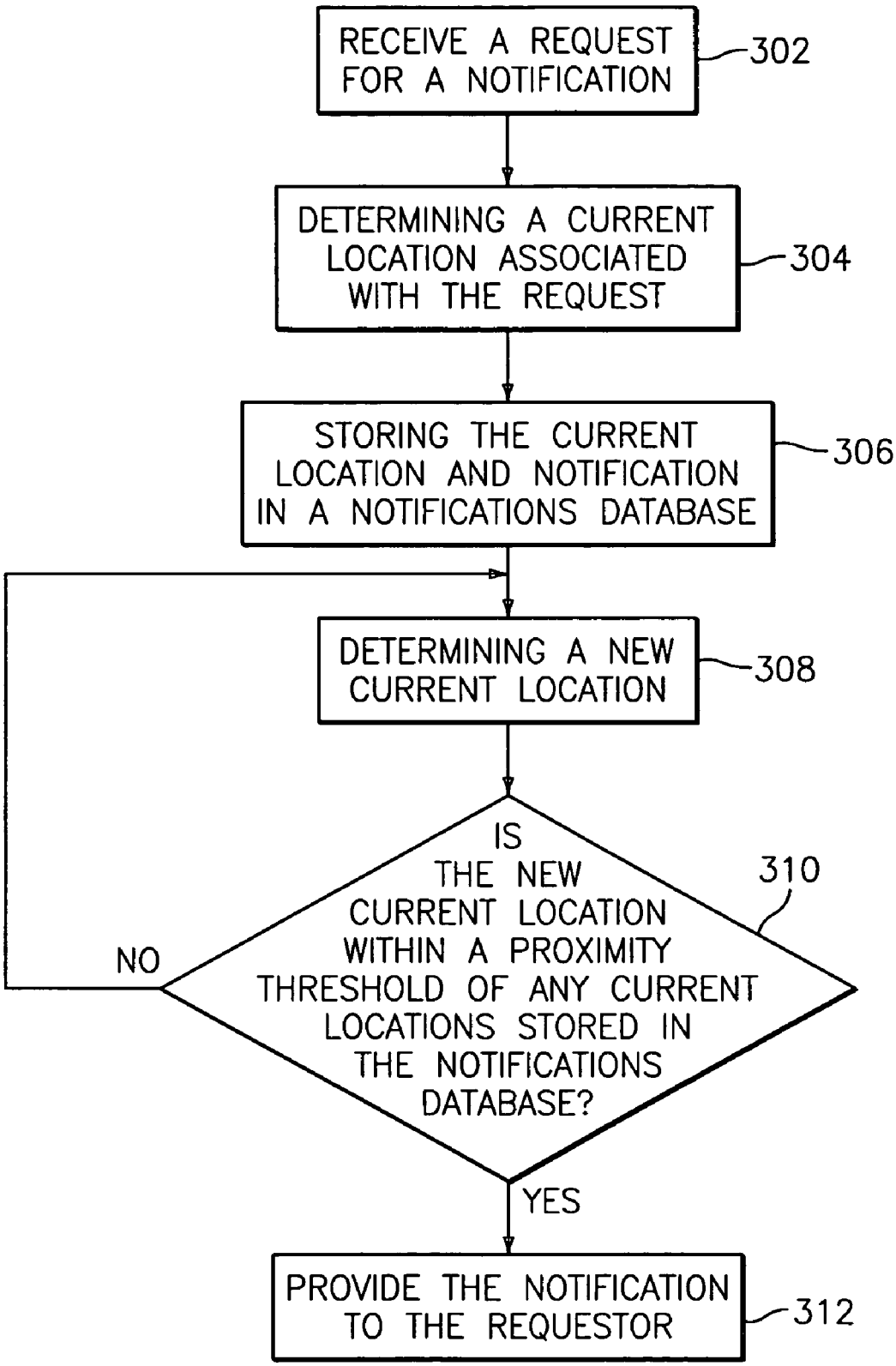
FIG. 3 is a process flow that may be utilized by exemplary embodiments of the present invention to provide location-based notifications.

FIG. 3 is a process flow that may be utilized by exemplary embodiments of the present invention to provide location-based notifications. In exemplary embodiments of the present invention, the process flow is performed and/or facilitated by the processor 202. At step 302, a request for a notification is received from a user at an input device 208. As described previously, the notification is received via the input device 108 and may include both header information 104 in a text format and voice content 106 in an audio format. At step 304, a current location of the input device 108 is determined by the location detection device 206 and associated with the requested notification. The current location associated with the requested notification is referred to herein as the reminder location. It is desirable for step 304 to be performed as soon as possible after step 302 in order to increase the accuracy of the reminder location. In addition, the setting of the reminder location may take into account the speed of the vehicle, etc. to provide increased accuracy of the reminder location. At step 306, the notification and associated reminder location are stored in the notifications database 210.

At step 308 in FIG. 3, a new current location is determined by the location detection device 206. At step 310, the new current location is compared to reminder locations stored in the notifications database 210. If the new current location is within a proximity threshold of any reminder locations, then step 312 is performed and a notification is provided to the requestor via an output device 204. Otherwise, processing loops back step 308 to determine a new current location. This loop occurs on a periodic basis (e.g., every half second, every second, every minute, every half mile).

In exemplary embodiments of the present invention, the proximity threshold is a fixed distance (e.g., half mile, one mile, five miles, etc) that has an installation default value that is user adjustable. In these embodiments, when the mobile user device or vehicle is within the specified threshold of a reminder location associated with a notification in the notifications database 210, a notification is provided to the requestor. In alternate exemplary embodiments, the user may override the default proximity threshold as part of the header information 104 for a particular notification. In this manner, the user is provided with notifications at different proximity thresholds depending on the user requirements for particular notifications.

In exemplary embodiments of the present invention, the type of notification that is provided at step 312 (e.g., visual, audio, and haptic) depends on an installation default value that may be modified by the user. In alternate exemplary embodiments, the user may override the default notification type as part of the header information 104 for a particular notification. In this manner, the user is provided with different types of notifications depending on the user requirements for particular notifications. For example, a user may specify that all notifications associated with a an importance of "high" include a haptic alert that vibrates the steering wheel for a few seconds before outputting the voice content 106 via the speakers. Alternatively, an importance of "high" may produce more vigorous vibrating than a notification with an importance of "low." The user may also specify that all notifications associated with an expiration date within the next two days include the haptic alert. Further, the user may specify that all other notifications include having the header information 104 being displayed (or alternatively, spoken) followed by playing back the recorded voice content 106. In this manner, a user may customize the type of notification received based on the content of the header information 104. In alternate exemplary embodiments, the user may override the user specified defaults for a particular header information 104 content and specify another type of notification for particular notification request.

Exemplary embodiments of the present invention may be implemented on any type of vehicle including automobiles, boats, trains and other forms of transportation. For example, a boat operator may use the system to remind himself or herself about reefs or other obstructions, or about how to navigating particular portions of a waterway. Also, as described previously, the system may be contained in a mobile user device that a user may carry around when at home, at work, in a vehicle, out for a walk, etc. The system described herein may be included in a cellular telephone or a personal data assistant (PDA) and share system components (e.g., the location detection device 206, the input device 208) with the cellular telephone or PDA. Further alternate embodiments include having the voice content being converted to text by a speech recognition device and being able to send notifications to other users (at mobile user devices or in vehicles).

As described above, the embodiments of the invention may be embodied in the form of hardware, software, firmware, or any processes and/or apparatuses for practicing the embodiments. Embodiments of the invention may also be embodied in the form of computer program code containing instructions embodied in tangible media, such as floppy diskettes, CD-ROMs, hard drives, or any other computer-readable storage medium, wherein, when the computer program code is loaded into and executed by a computer, the computer becomes an apparatus for practicing the invention. The present invention can also be embodied in the form of computer program code, for example, whether stored in a storage medium, loaded into and/or executed by a computer, or transmitted over some transmission medium, such as over electrical wiring or cabling, through fiber optics, or via electromagnetic radiation, wherein, when the computer program code is loaded into and executed by a computer, the computer becomes an apparatus for practicing the invention. When implemented on a general-purpose microprocessor, the computer program code segments configure the microprocessor to create specific logic circuits.

While the invention has been described with reference to exemplary embodiments, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. Moreover, the use of the terms first, second, etc. do not denote any order or importance, but rather the terms first, second, etc. are used to distinguish one element from another.

What is claimed is:

1. A method for providing location-based notifications, the method comprising:

receiving a request from an input device to create a location-based notification, wherein the request includes a speech recognition component configured to initiate the request and a speech recording component configured to be replayed;

determining a current location of the input device in response to receiving the request;

setting a reminder location responsive to the current location of the input device;

creating the location-based notification and associating it with the reminder location;

determining a new current location of the input device on a periodic basis;

comparing the new current location to the reminder location; and providing the notification if the new current location is within a proximity threshold of the reminder location, including replaying the speech recording component.

2. The method of claim 1 wherein the speech recognition component of the request is received via a microphone at the input device and stored as header information in a notifications database, and wherein the speech recording component of the request is received via the microphone at the input device and stored in the notifications database as an audio file associated with the header information.

3. The method of claim 1 wherein the speech recognition component is stored as text data.

4. The method of claim 1 wherein the speech recording component includes voice data.

5. The method of claim 1 wherein the notification includes header information in a text data format and voice content in a voice data format.

6. The method of claim 5 wherein a manner of the providing the notification varies based on the header information and the voice content of the notification.

7. The method of claim 1 wherein the providing notification includes a haptic alert.

8. The method of claim 1 wherein the providing notification includes one or more of an audio alert and a visual alert.

9. The method of claim 1 wherein the proximity threshold is user modifiable.

10. A system for providing location-based notifications, the system comprising:

an input device configured to receive a speech recognition component of a request to create a location-based notification, and a speech recording component of the request to create the location-based notification;

a location detection device;

an output device configured to replay the speech recording component of the request to create the location-based notification; and a processor in communication with the input device, the output device and the location detection device for facilitating:

receiving a request from the input device to create a location-based notification, wherein the request includes the speech recognition component and the speech recording component;

determining a current location of the input device using the location detection device, the determining in response to receiving the request;

setting a reminder location responsive to the current location of the input device;

creating the location-based notification and associating it with the reminder location;

determining a new current location of the input device using the location detection device on a periodic basis;

comparing the new current location to the reminder location; and providing the notification via the output device if the new current location is within a proximity threshold of the reminder location, including replaying the speech recording component.

11. The system of claim 10 wherein the input device includes a microphone and speech recognition software.

12. The system of claim 10 wherein the location detection device comprises a GPS device.

13. The system of claim 10 wherein the output device includes a speaker.

14. The system of claim 10 wherein the output device transmits a command to activate a haptic alert.

15. The system of claim 10 wherein the system is located within a mobile user device.

16. The system of claim 10 wherein the system is integrated into a vehicle and shares one or more of the input device, the location detection device, the output device and the processor with other functions provided by the vehicle.

17. A computer-readable medium for providing location-based notifications, the computer-readable medium including instructions for causing a processing circuit to implement a method, comprising:

receiving a request from an input device to create a location-based notification, wherein the request includes a speech recognition component configured to initiate the request and a speech recording component configured to be replayed;

determining a current location of the input device in response to receiving the request;

setting a reminder location responsive to the current location of the input device;

creating the location-based notification and associating it with the reminder location;

determining a new current location of the input device on a periodic basis;

comparing the new current location to the reminder location; and providing the notification if the new current location is within a proximity threshold of the reminder location, including replaying the speech recording component.

18. The computer-readable medium of claim 17 wherein the notification includes voice data.

19. The computer-readable medium of claim 17 wherein the notification includes header information in a text data format and voice content in a voice data format.

20. The computer-readable medium of claim 17 wherein a manner of the providing the notification varies based on the header information and the voice content of the notification.

* * * * *